United States Patent [19]

Moebus

[11] 4,175,502

[45] Nov. 27, 1979

[54] LIQUID-COOLED, ASSEMBLED PISTON FOR INTERNAL COMBUSTION ENGINES

[75] Inventor: Horst Moebus, Neckarsulm, Fed. Rep. of Germany

[73] Assignee: Karl Schmidt GmbH, Neckarsulm, Fed. Rep. of Germany

[21] Appl. No.: 908,421

[22] Filed: May 22, 1978

[30] Foreign Application Priority Data

May 25, 1977 [DE] Fed. Rep. of Germany ..... 2723619

[51] Int. Cl.[2] ..... F01P 3/10

[52] U.S. Cl. ..... 123/41.35; 123/193 P; 92/186

[58] Field of Search ..... 123/41.34, 41.35, 41.36, 123/41.37, 41.38, 41.39, 48 B, 78 B, 193 P, 193 CP; 92/186, 153

[56] References Cited

U.S. PATENT DOCUMENTS

| | | | |
|---|---|---|---|
| 1,187,737 | 6/1916 | Isham | 92/186 |
| 1,547,687 | 7/1925 | Rohwer | 92/186 |
| 3,136,306 | 6/1964 | Kamm | 123/41.38 |
| 3,314,402 | 4/1967 | Tillack | 92/186 |
| 3,465,651 | 9/1969 | Tromel | 92/186 |

FOREIGN PATENT DOCUMENTS

| | | | |
|---|---|---|---|
| 391944 | 3/1923 | Fed. Rep. of Germany | 123/41.35 |
| 711846 | 9/1941 | Fed. Rep. of Germany | 92/186 |
| 2424882 | 12/1975 | Fed. Rep. of Germany | 123/193 P |
| 36036 | 4/1930 | France | 92/186 |
| 106306 | 1/1943 | Sweden | 123/41.38 |
| 718612 | 11/1954 | United Kingdom | 92/186 |
| 779575 | 7/1957 | United Kingdom | 123/41.35 |
| 253485 | 3/1970 | U.S.S.R. | 123/193 P |

*Primary Examiner*—Charles J. Myhre
*Assistant Examiner*—Jeffrey L. Yates
*Attorney, Agent, or Firm*—Sprung, Felfe, Horn, Lynch & Kramer

[57] ABSTRACT

In a liquid cooled, assembled piston for an internal combustion engine which has a lower piston part, an upper piston part connected thereto, an annular cooling passage disposed in the upper piston part behind the top land and at least part of the ring-carrying portion thereof, an input coolant conduit in the lower piston part, a central cooling chamber disposed between the two piston parts and a supporting ring concentrically disposed on the underside of the upper piston part and between the annular cooling passage and the central cooling chamber, there is provided an oil guiding ring including a flange gripped between the two piston parts and a lip connected to the flange and protruding into the annular cooling passage for effecting the flow of the oil along the periphery of the cooling passage as it enters same from the input coolant conduit.

9 Claims, 3 Drawing Figures

LIQUID-COOLED, ASSEMBLED PISTON FOR INTERNAL COMBUSTION ENGINES

BACKGROUND OF THE INVENTION

The present invention relates to liquid cooled assembled pistons for internal combustion engines.

To comply with steadily increasing requirements of the market, a designer of pistons for modern high duty diesel engines for medium speeds must furnish the engine manufacturer with pistons which are abreast of the technical development of the engines. A steady increase in functional reliability and service life are of special importance. High combustion pressures and combustion temperatures must be achieved with practicable technical means, which depend on the material and the processing thereof and also on economic considerations. In cooperation with the engine manufacturer, the piston designer usually finds a compromise, which represents an optimum with respect to costs and performance. At the present state of the art, all requirements regarding factor of safety and service life are met by a cooled, assembled piston.

To minimize the dimensions and weights of high-duty diesel engines, it is known to make the upper part of the piston from a heat-resisting ferrous material, particularly low-carbon steel, to make the lower part from an aluminum alloy for pistons, and to connect the two parts to each other by tie rods or screws. Adjacent to the interfacial plane between the parts of the piston, cooling chambers are provided for dissipating the heat which is contained in the upper portion of the piston inasmuch as the heat cannot be dissipated otherwise.

Such pistons usually have a relatively shallow combustion chamber recess so that the highest piston head temperature, lying above 350° to 400° C., occurs at the oblique outer edge of the recess owing to the configuration of the jets of fuel injected through nozzles. Temperatures of about 240° to 270° C. may be obtained at the corresponding portion of the inside surface of the cooling passage, which surface is wetted by coolant oil. These temperatures result in yellow to blue temper colors on the steel surface and are close to or above the spontaneous ignition temperature of commercially available lubricating oils for diesel engines.

The experience had with such pistons in practice has confirmed the belief that the coolant oil cokes very rapidly in that portion of the cooling passage and forms an insulating oil coke layer which reduces the cooling action so that the temperatures are greatly increased, the strength properties of the piston material are decreased, the creep strength is reduced and the thermal deformation is increased. It has repeatedly been observed that this may result in permanent deformation.

SUMMARY OF THE INVENTION

It is an object of the present invention to provide in a liquid cooled piston of the type hereinbefore described, for a controlled local concentration and improvement of the cooling action, particularly in the hottest portion of the upper piston part, so that the temperature of the surfaces to be cooled is as low and as uniform as possible.

This object is accomplished according to the present invention wherein an oil-guiding ring is gripped between the upper piston part and the lower piston part by means of a flange or like means and is provided with a lip, which protrudes into the cooling passage and which is so disposed that the coolant flows along the periphery of the cooling passage as it enters the latter. This results in an improved cooling action in the cooling passage owing to the longer residence time of the coolant, its higher velocity relative to the surface of the piston material, and the fact that the laminar boundary layer is destroyed by the turbulence in the cooling passage.

In adaptation to the configuration of the cooling chamber the lip may be inclined at an angle between about 10° and 90°, preferably about 30° to 60°, with respect to the longitudinal axis of the piston.

This lip itself may be curved in order to provide for a desired direction of flow or an improved degree of interception.

Additionally, the flange and lip may be separately made from materials having different, though high thermal conductivities, such as iron, steel or cast iron and then be assembled to form the oil-guiding ring.

According to a preferred feature of the invention, the axially extending coolant supply and discharge conduits which are connected to the cooling passage communicate with the cooling passage through bores in the flange of the oil-guiding ring.

In a particularly advantageous embodiment of the invention, a concentrically disposed, cup-shaped oil-guiding ring is gripped between a supporting ring and the opposite bearing surface of the lower piston part and has an outer flange rim, which is provided with the lip, and the rim and lip protrude into the cooling passage.

The radial coolant bores which connect the cooling passage to the cooling chamber are suitably disclosed in the flange of the oil-guiding ring.

In special cases, an arrangement may be suitable in which the flange of the oil-guiding ring is gripped between an annular peripheral retaining nose, which is provided in the upper piston part at the outer radial inside surface of the cooling passage, on the one hand, and the opposite surface of the lower piston part, on the other hand.

In the assembled piston according to the invention, the coolant can be conducted through the central coolant chamber into the cooling passage and through the cooling passage into the cooling chamber. The oil may be supplied through the piston pin or a sliding shoe on the connecting rod, or through injection nozzles which are fixed to the housing, or on the connecting rod small end.

The direction of rotation of the coolant moving in the cooling passage can be controlled and the cooling action can thus be locally influenced by the position of the supply passages.

These and other objects of the present invention will become apparent from the following when read in connection with the accompanying drawings which show pistons according to the invention by way of example.

DETAILED DESCRIPTION OF THE INVENTION

Figure 1:
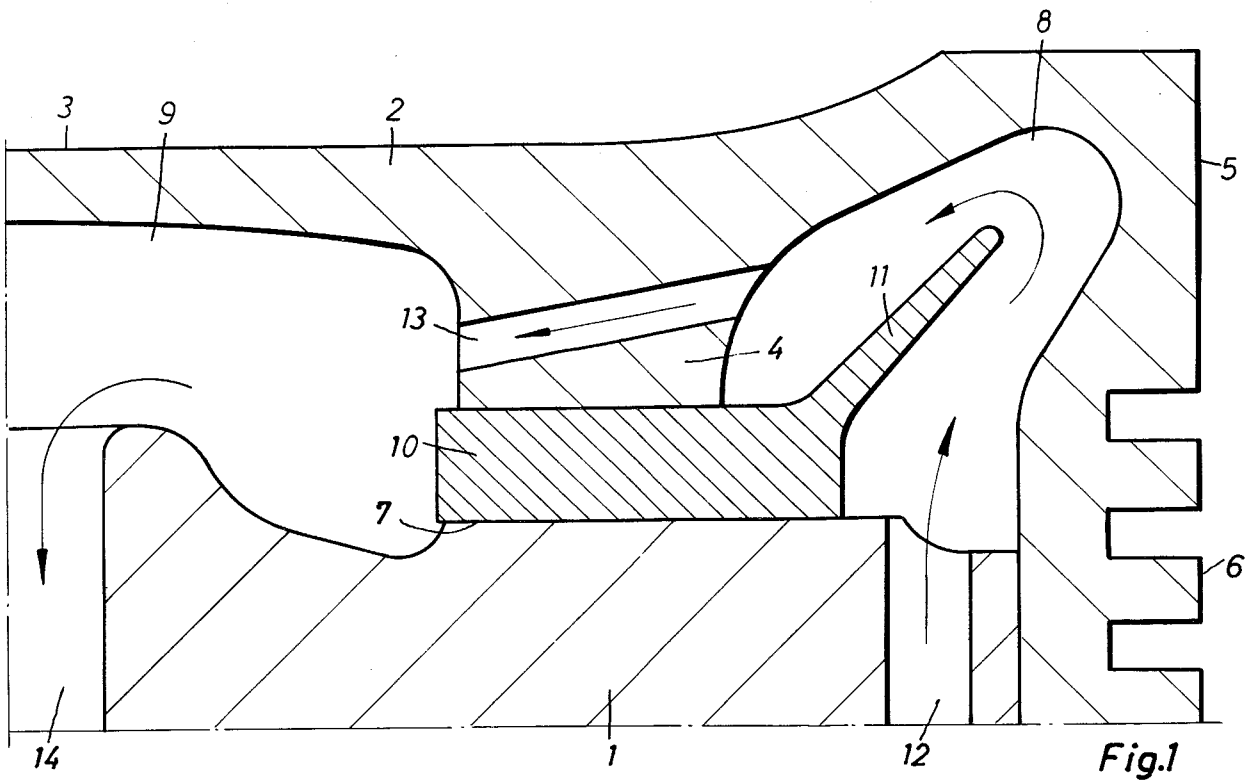
FIG. 1 is a cross-sectional view of a piston according to the present invention.

The piston shown in FIG. 1 consists of a lower piston part 1 and an upper piston part 2, which are connected by threaded tie rods, not shown. The lower piston part 1 preferably consists of a eutectic aluminum-silicon alloy and the upper piston part 2 preferably consists of a steel. A concentrically disposed supporting ring 4 is arranged on the underside of the piston head 3 and has a radially outer surface, which forms the radial inner boundary wall of the cooling passage 8, which is disposed behind the top land 5 and the ringcarrying portion 6 and is open to the interfacial plane. The supporting ring 4 encloses a centrally disposed cooling chamber 9. A cuplike oil-guiding ring consisting of flange 10 and lip 11 is gripped between the supporting ring 4 and the opposite bearing surface of the lower piston part 1 in such a manner that the outer edge of the flange 10 and the lip 11 protrude into the cooling passage 8.

A coolant supply conduit 12 opens into the cooling passage 8 and communicates through suitable bores with the coolant-circulating system, not shown. The coolant flows through the coolant supply conduit 12 into the cooling passage 8 and is diverted by the lip 11 to flow substantially along the periphery of the cooling passage. The coolant then flows through radial bores 13 in the supporting ring 4 into the central cooling chamber 9, from which it flows back through the outlet opening 14 into the interior of the crankcase.

Figure 2:
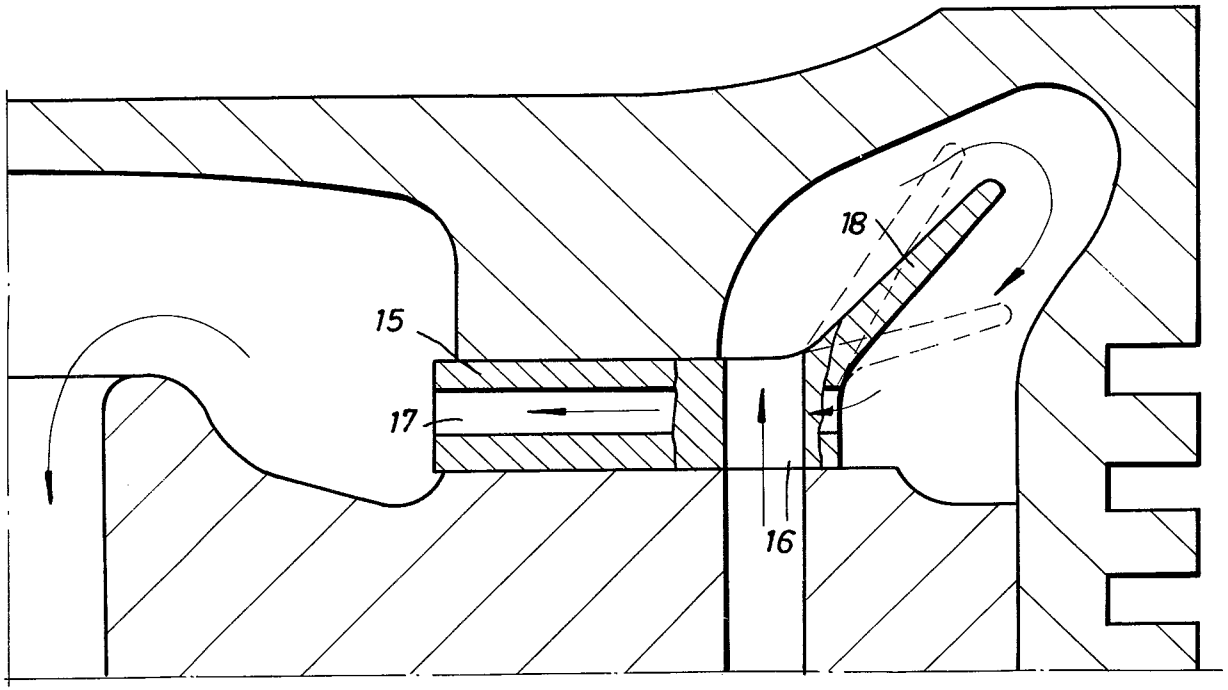
FIG. 2 is a cross-sectional view of another embodiment of a piston according to the present invention.

In the modified piston shown in FIG. 2 the coolant supply conduit 12 opens into the cooling passage 8 through a bore 16, which is formed in the flange 15 of the oil-guiding ring and extends along the lip 18. The coolant flows along the periphery of the cooling passage and through radial bores 17 in the flange 15 into the central cooling chamber 9 and from the latter through the outlet opening 14 into the interior of the crankcase. The lip 18 may have various angles of inclination, as indicated by dotted lines, in order to control the cooling action.

Figure 3:
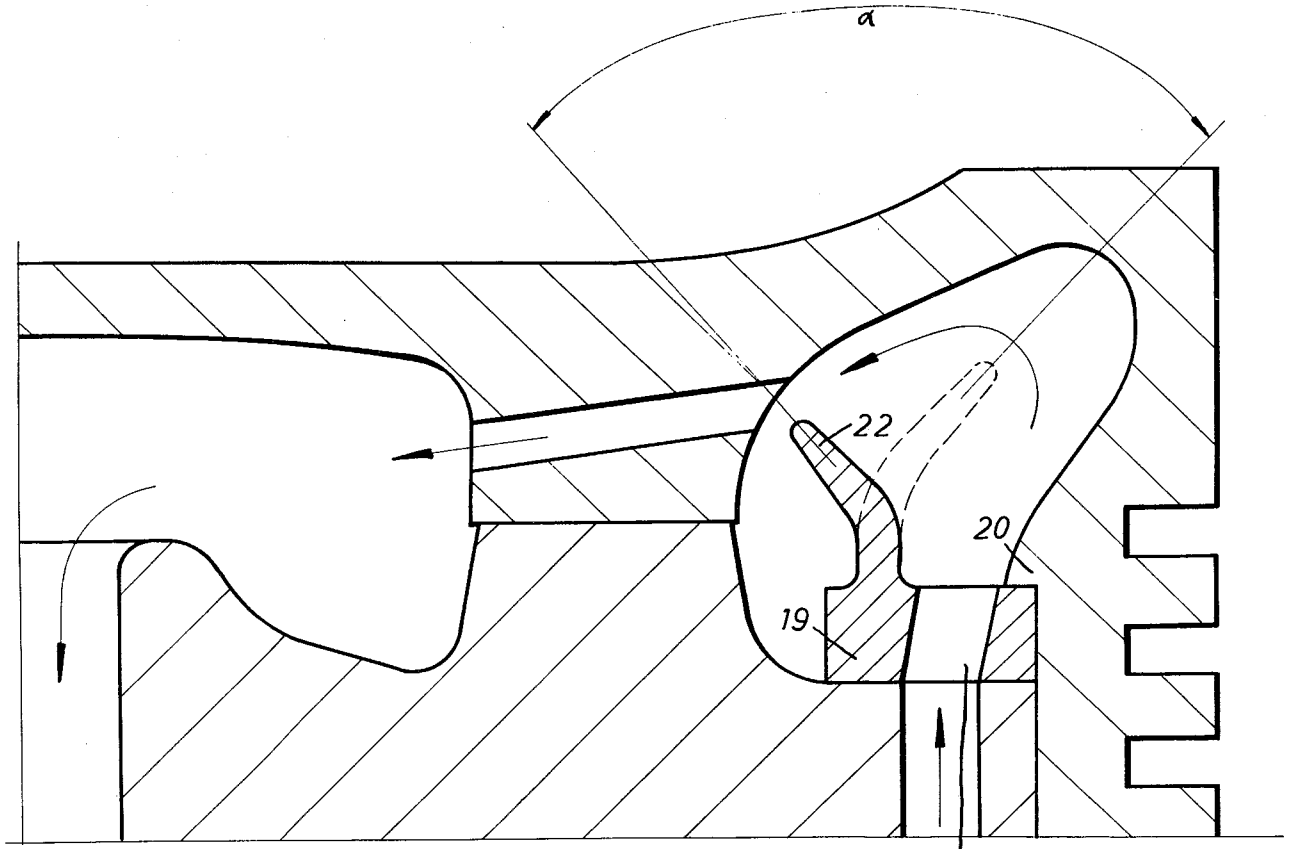
FIG. 3 is a cross-sectional view of a further embodiment of a piston according to the present invention.

A further embodiment of the piston according to the invention is shown in FIG. 3 and comprises an oil-guiding ring having a flange 19, which is gripped at its outer rim between a retaining nose 20 and the opposite flange of the lower piston part 1. The retaining nose 20 is provided on the radially outer boundary surface of the cooling passage 8. The coolant supply conduit 12 opens into the cooling passage 8 through a bore 21 in the flange 19. The lip 22 is curved so that the coolant forms a sump between the lip 22 and the opposite surface defining the cooling passage 8, and may have various angles of inclination over a range $\alpha$, as indicated by the dotted lines, in order to control the cooling action.

The advantages afforded by the invention reside in that the design according to the invention, particularly the arrangement of the oil-guiding ring, result in an increase of the cooling action by about 20–25% so that the life of the lubricant preferably used as a coolant is considerably prolonged. This is because local peak temperatures at the oil-wetted surfaces of the cooling passage and cooling chamber are decreased so that the lubricating oil oxidizes much more slowly.

Additionally, a long-term deformation of an upper piston part at elevated temperatures is avoided and the life of the piston is increased.

The small thermal deformation ensures an exact guidance of the piston rings so that their life is prolonged too. This is closely related to the wear and life of the cylinder liner, the behavior of which is also favorably influenced.

It is apparent that in the piston according to the invention the area of the heat-dissipating surfaces, the relative velocity of the coolant, and the reduction of the laminar boundary layer of the coolant contribute to an improvement of the cooling action.

It will be appreciated that the instant specification and examples are set forth by way of illustration and not limitation, and that various modifications and changes may be made without departing from the spirit and scope of the present invention.

What is claimed is:

1. In a liquid-cooled, assembled piston for an internal combustion engine of the type having a lower piston part, an upper piston part connected to the lower piston part, an annular cooling passage disposed in the upper piston part behind the top land and at least part of the ring-carrying portion thereof, an input coolant conduit in the lower piston part, a central cooling chamber disposed between the two piston parts, and a supporting ring concentrically disposed on the underside of the upper piston part and between the annular cooling passage and the central cooling chamber, wherein the improvement comprises: means providing communication between the annular cooling passage and the central cooling chamber, and oil-guiding means for effecting the flow of the oil along the periphery of the cooling passage as it enters same from the input coolant conduit, the liquid guiding means comprising an oil guiding ring including a flange gripped between the two piston parts and a lip connected to the flange and protruding into the annular cooling passage.

2. A piston according to claim 1, wherein the oil-guiding ring is composed of a material having a high thermal conductivity and the lip extends at an angle of 10° to 90°, with respect to the longitudinal axis of the piston.

3. A piston according to claim 1, wherein the lip is arcuate in cross-section.

4. A piston according to claim 1, wherein the flange and the lip comprise separate materials having a high thermal conductivity.

5. A piston according to claim 1, wherein the liquid guiding means comprises bores in the flange of the oil-guiding ring in communication between the input coolant conduit and the annular cooling passage.

6. A piston according to claim 1, wherein the oil-guiding ring is cup-shaped and is gripped between the supporting ring and the opposite bearing surface of the lower piston part.

7. A piston according to claim 1, wherein the means providing communication comprises radial coolant bores in the flange of the oil-guiding ring.

8. A piston according to claim 1 comprising an annular peripheral retaining nose in the upper piston part at the outer radial inside surface of the cooling passage for gripping the flange between same and the opposite surface of the lower piston part.

9. A piston according to claim 5 wherein the means providing communication comprises radial coolant bores in the flange of the oil-guiding ring.

* * * * *